US006581242B2

(12) United States Patent
Owens

(10) Patent No.: US 6,581,242 B2
(45) Date of Patent: Jun. 24, 2003

(54) TRACK AND TROLLEY SYSTEM FOR MOVABLE WALL PANELS

(75) Inventor: N. Douglas Owens, Lynn, IN (US)

(73) Assignee: Modernfold, Inc., New Castle, IN (US)

( * ) Notice: Subject to any disclaimer, the term of this patent is extended or adjusted under 35 U.S.C. 154(b) by 141 days.

(21) Appl. No.: 09/797,127

(22) Filed: Mar. 1, 2001

(65) Prior Publication Data

US 2002/0121001 A1 Sep. 5, 2002

(51) Int. Cl.[7] ..... E05D 15/06

(52) U.S. Cl. ..... 16/89; 16/97; 16/107; 160/196.1; 384/55; 312/334.39

(58) Field of Search ..... 16/89, 90, 91, 16/107, 97, 87 B, 87.6 R, 96 R; 160/196.1, 200; 49/409; 384/19, 55, 58; 104/94, 95; 105/154, 155; 312/334.41, 334.39

(56) References Cited

U.S. PATENT DOCUMENTS

| | | | | | |
|---|---|---|---|---|---|
| 2,654,114 | A | | 10/1953 | Graber et al. | |
| 3,042,960 | A | | 7/1962 | Spork | |
| 3,253,552 | A | | 5/1966 | Stein | |
| 3,293,685 | A | | 12/1966 | Rosenbaum | |
| 3,509,665 | A | | 5/1970 | Bartlett et al. | |
| 3,813,728 | A | * | 6/1974 | Johnson | 16/105 |
| 3,879,799 | A | | 4/1975 | Williams | |
| 4,141,106 | A | | 2/1979 | Dixon | |
| 4,302,865 | A | * | 12/1981 | Dixon et al. | 16/102 |
| 4,401,033 | A | | 8/1983 | Gerken | |
| 4,620,801 | A | * | 11/1986 | MacDonald | 312/334.39 |
| 4,726,637 | A | | 2/1988 | Ishizawa et al. | |
| 4,729,615 | A | | 3/1988 | Ishizawa et al. | |
| 4,800,619 | A | | 1/1989 | Hudak | |
| 4,837,891 | A | | 6/1989 | Toma et al. | |
| 5,152,332 | A | | 10/1992 | Siener | |
| 5,181,296 | A | * | 1/1993 | Williams | 104/94 |
| 5,329,857 | A | | 7/1994 | Owens | |
| 5,406,676 | A | | 4/1995 | Williams | |
| 6,058,656 | A | * | 5/2000 | Bischof et al. | 16/106 |

* cited by examiner

*Primary Examiner*—Anthony Knight
*Assistant Examiner*—William D Hutton, Jr.
(74) *Attorney, Agent, or Firm*—Baker & Daniels

(57) ABSTRACT

A track and trolley system for movable wall panels including a track having upper and lower flanges, the upper and lower flanges being horizontally and vertically displaced from each other and defining a channel therebetween, the upper and lower flanges each having a disc-supporting surface; a carrier shaft disposed between the flanges and adapted to engage the wall panel; and a trolley having upper and lower discs rotationally mounted on the shaft, the upper and lower discs each having a lower surface supported on the disc-supporting surfaces of the upper and lower flanges, respectively, and each of the upper and lower discs including an outer edge and a center, each of the lower surfaces sloping upwardly from the outer edge toward the center, each of the lower surfaces including a contact portion adjacent the outer edge and engaging the disc-supporting surface.

46 Claims, 4 Drawing Sheets

TRACK AND TROLLEY SYSTEM FOR MOVABLE WALL PANELS

BACKGROUND OF THE INVENTION

This invention relates to a multi-directional suspension system for supporting movable wall panels, such as those used to partition large rooms into smaller rooms, and particularly, for movable wall panels which are suspended from an overhead track.

Where large spaces are intended to be temporarily subdivided into smaller rooms in, for example, hotels, convention halls, and the like, usually a suspended movable wall panel system is provided which permits movement of subdividing panels between the point of intended use and a storage area that is removed from the space being subdivided. These systems typically include an overhead track and trolley suspension system. The wall panels are moved from the storage area to points of use by moving them along the track which can include right angle turns and/or across intersections.

Among the objectives of trolley and track systems that suspend movable wall panels are: (1) to allow the walls to be moved with as little friction as possible; (2) to keep the wall panels properly centered within the track; (3) to reduce the shock caused by a trolley impacting a stationary object such as a track intersection and to allow panels to sway; and (4) to allow the panels to be easily moved across track intersections and right angled turns without the trolleys becoming dislodged from the track.

Various designs, such as those described in U.S. Pat. Nos. 3,042,960, 3,879,799 and 4,401,033, provide track and trolley systems having upper and lower discs, with opposite sides of the upper and lower discs engaging flanges or ledges on the track. These designs exhibit one or more of various problems, including increased wear of the track at joints and intersections, unequal loading of the discs, dislodgment of the trolley from the track at intersections, or load shifting due to the lack of a self-plumbing feature between the track and trolley. These problems are particularly acute when negotiating angle turns.

SUMMARY OF THE INVENTION

The present invention provides a track and trolley system for movable wall panels. The system includes a track having a pair of longitudinally extending flanges vertically and horizontally displaced from each other. The trolley uses a carrier shaft vertically disposed between the flanges. A pair of counter-rotating discs are vertically displaced from each other and rotationally mounted on the carrier shaft. In a preferred embodiment, the carrier shaft is a pendant bolt, which is configured for connection to a wall panel at its lower end so that the movable wall panel is supported by the track through the discs and the bolt.

The upper disc engages and is supported by the upper flange on one side of the shaft. The lower disc similarly engages and is supported by the lower flange on the other side of the shaft. The disc-supporting surface of each flange includes inner, middle, and outer regions upwardly curved and extending transversely across the flange. Each region is formed with a different radius of curvature so that the contour of the flange changes from region to region. The lower surface of the discs slopes inwardly and upwardly so that the discs contact the flanges at their outer edges.

The components are sized so that the discs are nominally supported at the outer region of the flanges. Preferably, the inner region of the flange is radiused at about 10 inches, the middle region at about 1 inch and the outer region at about 4 inches. Preferably, the disc lower surface slopes upwardly at about 4 degrees to the horizontal.

The upward slope of the lower surface of the discs combined with the curved contour of the flanges results in a relatively small contact area between the discs and flanges. Through this relatively small contact area along with the counter rotation of the discs, the invention accomplishes one primary objective of providing a track and trolley system that allows the panels to be moved with a minimum of friction. Another object is to provide a carrier, which negotiates the track intersections, and/or right angle turns more effectively. A further object is to provide a track and trolley system that will keep the wall panels properly centered within the track.

These and other objects, advantages, and benefits are accomplished according to the devices of the following descriptions of the preferred embodiments of the present invention.

DESCRIPTION OF THE PREFERRED EMBODIMENTS

Figure 1:
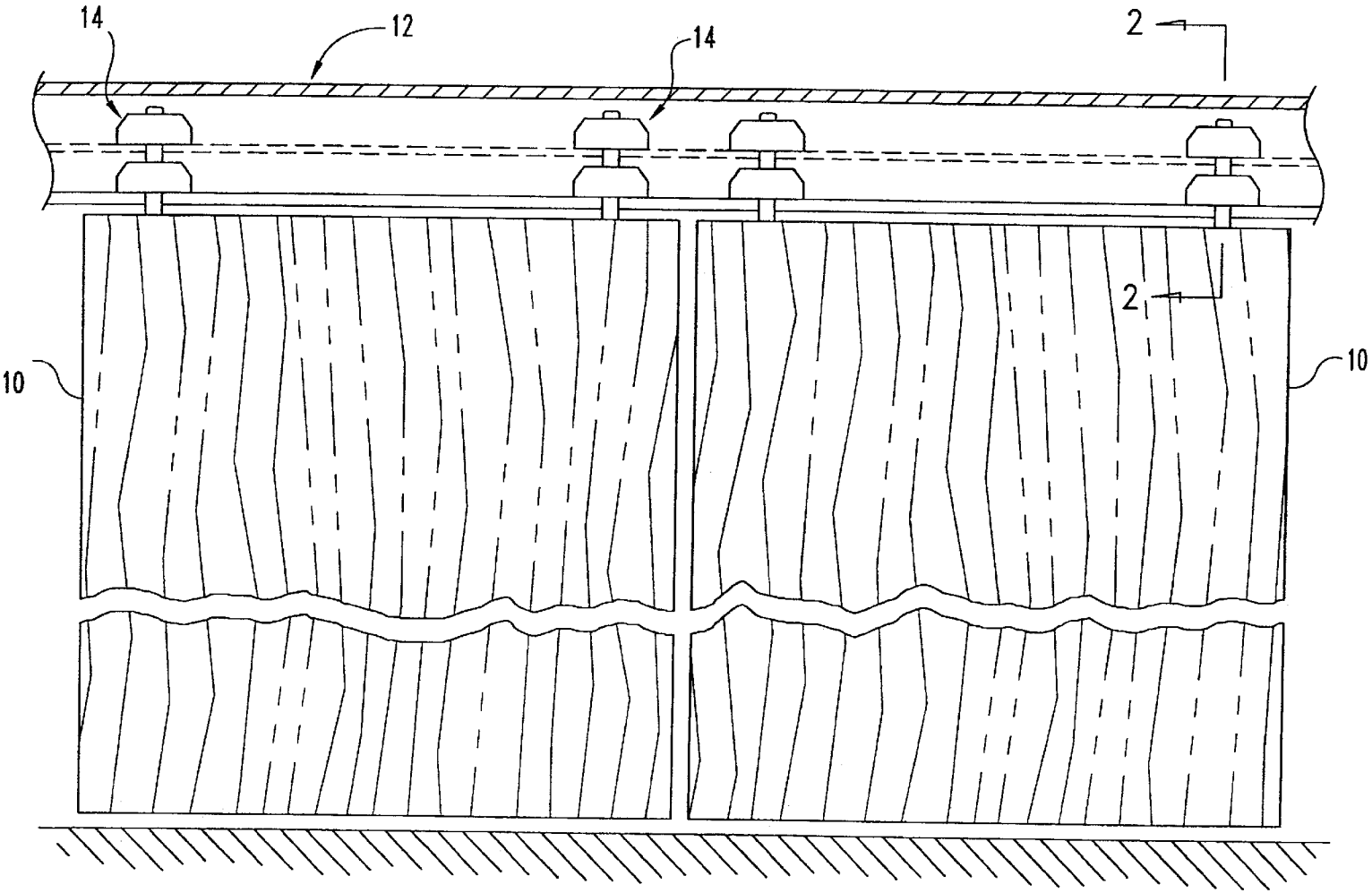
FIG. 1 is a front elevational view of a movable wall panel system using the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. The inventions includes any alterations and further modifications in the illustrated devices and described methods and further applications of the principles of the invention which would normally occur to one skilled in the art to which the invention relates.

One form of a movable wall system is shown in FIG. 1. The system includes a number of movable panels such as panel 10, that can be slidably suspended from a track 12 by a pair of trolleys or carriers 14. A similar movable panel system is described in U.S. Pat. No. 4,837,891, which is owned by the assignee of the present invention and which is hereby incorporated by reference.

Figure 2:
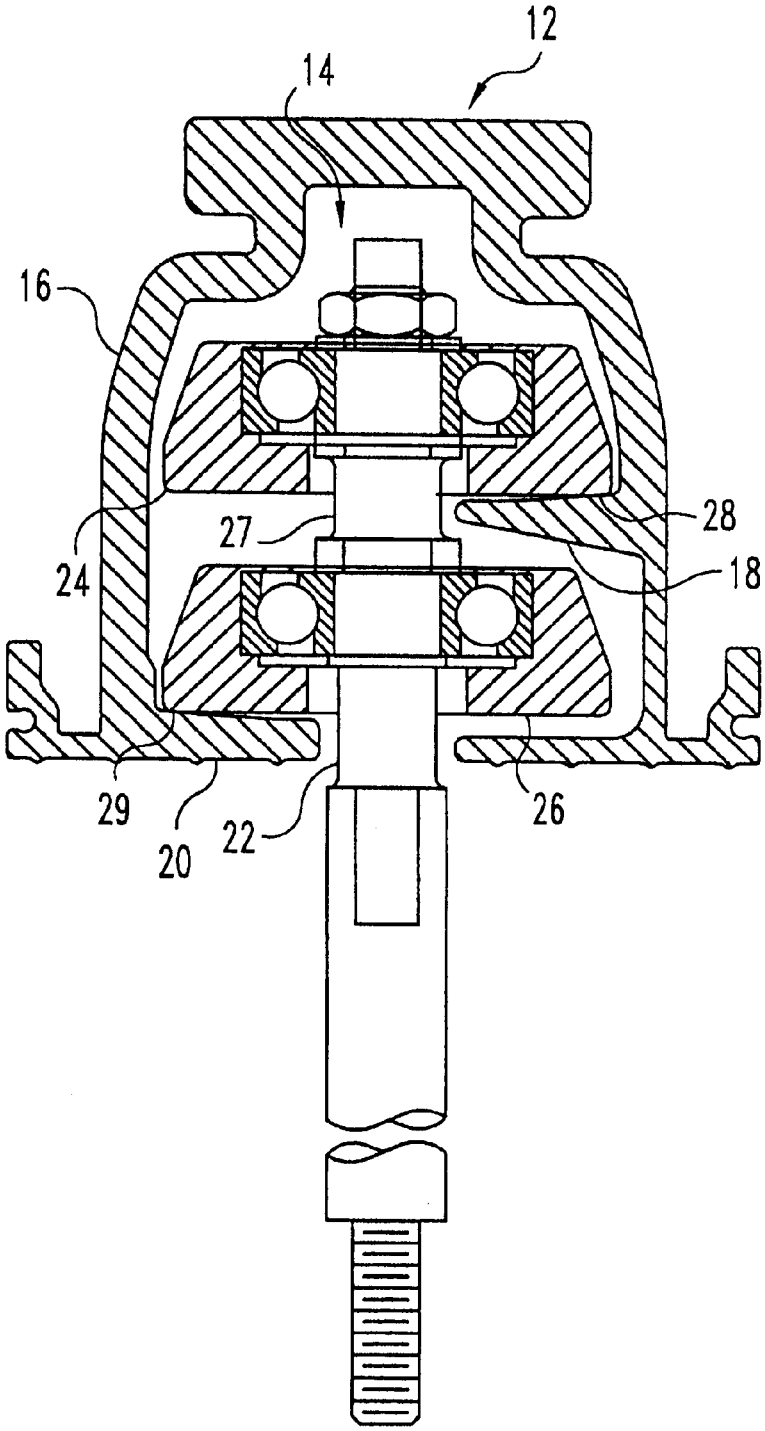
FIG. 2 is a cross-sectional view of a track and trolley assembly according to one embodiment of the present invention, taken from line 2—2 in FIG. 1 as viewed in the direction of the arrows.

As shown in FIG. 2 track 12 preferably forms a continuous housing enclosing the trolley 14. Two flanges 18 and 20 project from the track wall 16. Thus the housing formed by track 12 is common to flanges 18 and 20. Flanges 18 and 20 are preferably vertically and horizontally displaced from each other as shown in FIG. 2. Most preferably the flanges 18 and 20 are integral with the track wall 16 as shown. The track can be of extruded construction from a metal such as aluminum.

With reference still to FIG. 2, carrier shaft 22 extends vertically through the space 21 (see FIG. 4) between flanges 18 and 20. The lower end of carrier shaft 22 can be configured for attachment to a movable wall panel. In a preferred embodiment, the carrier shaft 22 can be a pendant bolt.

Figure 3:
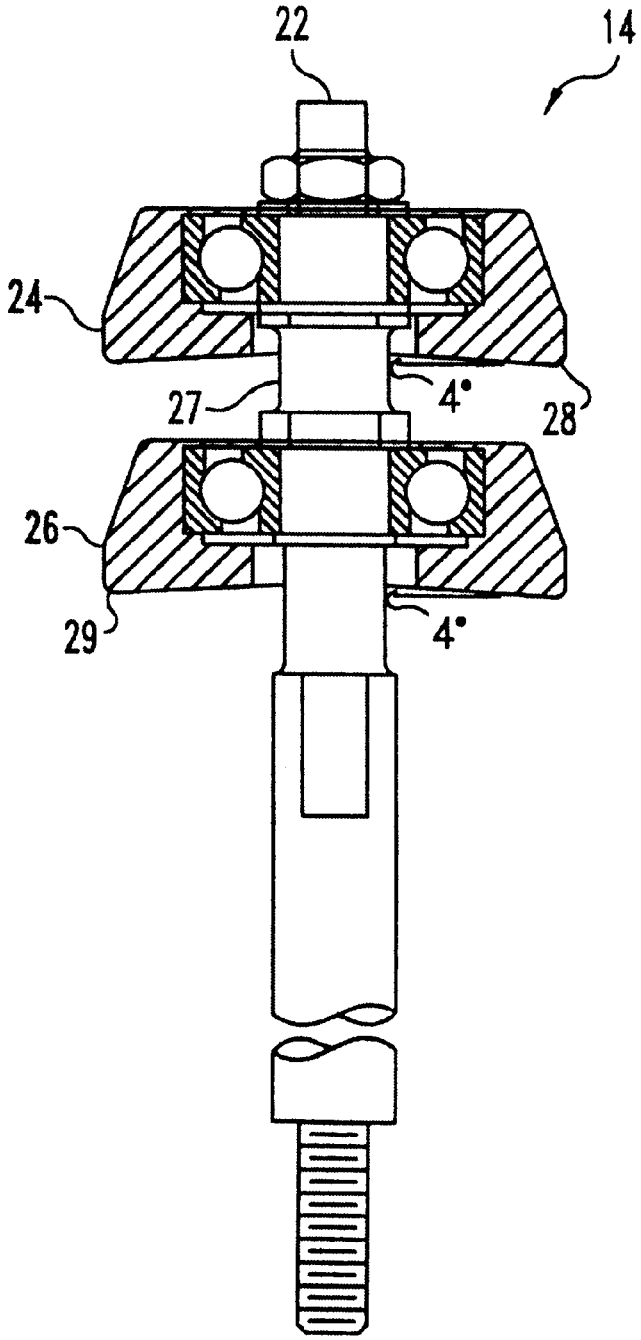
FIG. 3 is a cross-sectional view of the trolley of FIG. 2 removed from the track.

The trolley 14 is shown removed from the track 12 in FIG. 3. A pair of counter-rotating discs 24 and 26 are vertically spaced and rotationally mounted on carrier shaft 22. Spacer 27 can be used to separate the discs on the shaft. The discs 24 and 26 can be mounted on carrier shaft 22 by any of various methods well known in the art. The lower side of discs 24 and 26 exhibit an upward slope from their outer edges toward their centers. Preferably, the angle of slope is about 4 degrees to the horizontal. At this angle, the lower side of the disc is better able to retain lubricating grease. Preferably the lower surface of the discs exhibit a rounded outer edge. Disc-to-flange contact points 28 and 29 are located at about the juncture between the sloped lower surface and the rounded outer edge of the lower side of discs 24 and 26. Contact points 28 and 29 are preferably rounded and most preferably at a radius of about 0.60 inches.

Returning to FIG. 2, upper disc 24 engages and is supported by upper flange 18, while lower disc 26 is similarly supported by the lower flange 20. Discs 24 and 26 engage flanges 18 and 20 near their outer edges as indicated by contact points 28 and 29. A limited contact area results from the respective contours of the engaged surfaces reducing the frictional resistance to movement of the panels.

Figure 4:
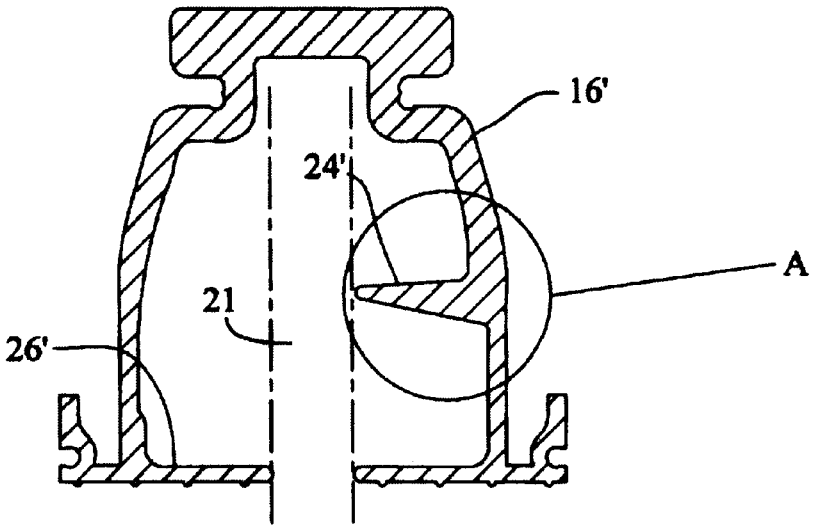
FIG. 4 is a cross-sectional view of the track of FIG. 3 showing detail section A.
Figure 5:
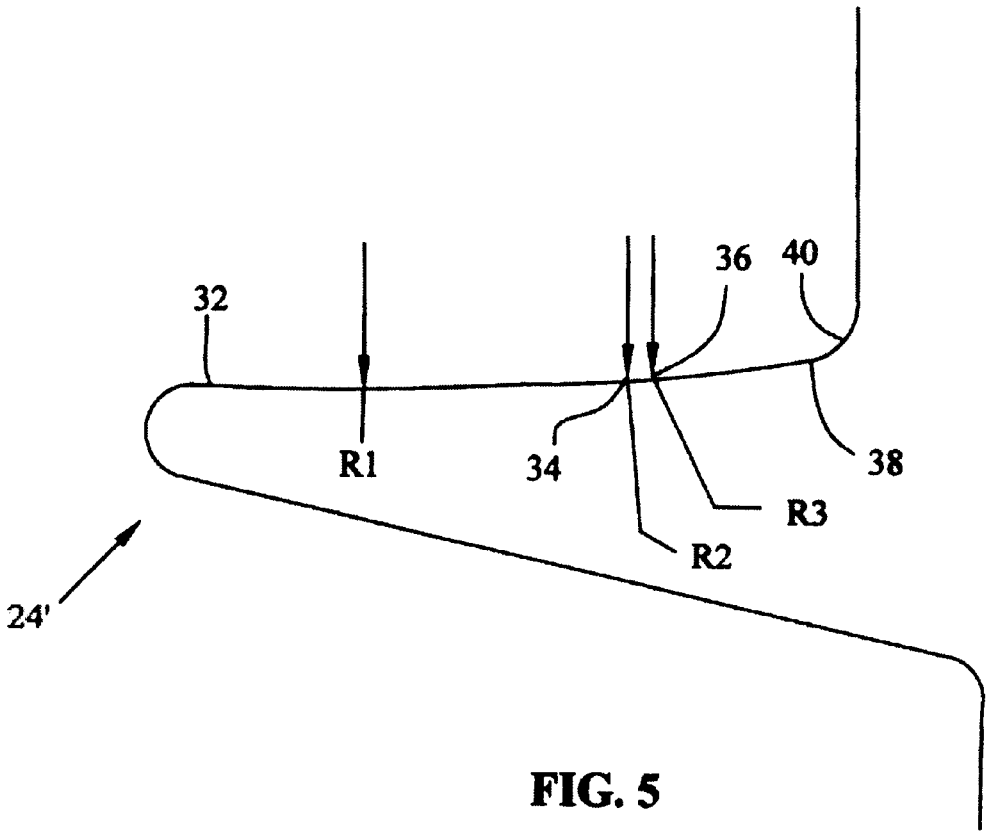
FIG. 5 is an enlarged view of the detail of section A of FIG. 4.

The disc-supporting surfaces of flanges 18 and 20 are arcuate in nature and exhibit a variable curvature which will now be described. Turning to FIG. 4, a track according to the present invention is shown including housing 16' and an upper flange 24'. The area within circle A is shown in more detail in the enlarged view of FIG. 5. In accordance with the invention, flange 24' has a rounded tip 32 at its inner end. The disc-supporting surface of flange 24' is a blend of three separate curvatures or cylindrical contours which are all upwardly concave. Points 32 and 34 define an inner region of the disc surface that is formed with a radius of curvature, R1. In a most preferred embodiment, radius R1 is about ten inches. Between points 34 and 36 is a transition region formed with a radius of curvature, R2. In a most preferred embodiment radius R2 is about one inch. This transition region between points 34 and 36 is a middle region that connects the inner region of the flange with the outer region of the flange, which extends between points 36 and 40. Most preferably this outer region has a radius of curvature, R3, of about four inches.

The components are preferably sized so that the contact point of the discs is nominally in the outer region of the flange as indicated at about point 38. It is desirable to have the contact point in the outer region so that the discs are self-plumbing and the disc-to-flange contact area is minimized.

The relatively long radius R1 of the inner region provides an extended surface to support the trolley discs while moving across intersections. This feature accommodates the drop that occurs while traversing intersections. The transition region at radius R2 allows the discs to move between the inner and outer regions of the flanges without binding.

The design and contour of the lower track flange 26' and its disc-supporting surface can be identical to that of upper track flange 24' and its disc-supporting surface just described. Likewise, the contact point of the lower disc with the disc-supporting surface of the lower flange can be the same as that between the upper disc and the upper flange.

As can be seen from FIG. 2 since each disc is in contact with a flange on only one side, the discs will rotate in opposite directions as the trolley is moved along the track. The minimal contact area resulting from the contours of the discs and their supporting surfaces on the flange allow wall panels to be moved with a minimum of friction.

Also, the track and trolley system is self-plumbing so that when the trolley is mounted for movement along the track, the discs of the trolley will always remain in contact with their respective flanges, even if the center line of the trolley and track are slightly misaligned.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A trolley for use in a track and trolley system having a track including at least one flange having a disc-supporting surface, said trolley comprising upper and lower discs, each of said upper and lower discs including a center and a lower surface, said lower surface including an outer edge wherein said lower surface slopes from said outer edge toward said center such that said lower surface is concave, said lower surface including a contact portion adjacent said outer edge and adapted to engage the disc-supporting surface.

2. The trolley of claim wherein the slope of said lower surface is about 4 degrees to the horizontal.

3. A track for use in movable wall panel systems having a trolley including a carrier shaft adapted to engage the wall panel and a trolley having upper and lower discs rotationally mounted on the shaft, each of the upper and lower discs having a lower surface, said track comprising:

upper and lower flanges, said upper and lower flanges being horizontally and vertically displaced from each other and defining a channel therebetween, the carrier shaft being disposable between said flanges, said upper and lower flanges each including a disc-supporting surface having inner, middle and outer cylindrically contoured regions, each of said inner, middle and outer regions having a different curvature, said outer region of said upper and lower flanges supporting the lower surfaces of the upper and lower discs, respectively.

4. The track and trolley system of claim 3, wherein the radius of curvature each of said inner and outer regions is greater than said radius of said middle region.

5. The track and trolley system of claim 4, wherein said inner, middle and outer regions have a radius of about 10 inches, 1 inch, and 4 inches, respectively.

6. A track and trolley system for movable wall panels comprising:

a track having upper and lower flanges, said upper and lower flanges being horizontally and vertically displaced from each other and defining a channel, said upper and lower flanges each having a disc-supporting surface;

a carrier shaft disposed between said flanges and adapted to engage the wall panel; and a trolley having upper and lower discs rotationally mounted on said shaft, said upper and lower discs each having a lower surface supported on said disc-supporting surfaces of said upper and lower flanges, respectively, and each of said upper and lower discs including an outer edge and a center, each of said lower surfaces sloping from said outer edge toward said center such that each of said lower surfaces is concave.

7. The track and trolley system of claim 6, wherein each of said disc supporting surfaces includes inner, middle and outer cylindrically contoured regions, each of said inner, middle and outer regions having a different curvature.

8. The track and trolley system of claim 7, wherein the radius of curvature of each of said inner and outer regions is greater than said radius of said middle region.

9. The track and trolley system of claim 8, wherein said inner, middle and outer regions have a radius of about 10 inches, 1 inch, and 4 inches, respectively.

10. The track and trolley system of claim 7, wherein the slope of each of said lower surfaces of said upper and lower discs is about 4 degrees to the horizontal.

11. The track and trolley system of claim 7, wherein said channel has a center point defining a distance from said center point to said outer region, and each of said upper and lower discs has a radius from said center to said outer edge corresponding to said distance.

12. The track and trolley system of claim 7, wherein each of said lower surfaces of said upper and lower discs defines a rounded contact point adjacent said outer edge, said rounded contact point of said upper and lower discs abutting said outer region of said upper and lower flanges, respectively.

13. A track and trolley system for movable wall panels comprising:

a track having upper and lower flanges, said upper and lower flanges being horizontally and vertically displaced from each other and defining a channel, said upper flange having a first disc-supporting surface including inner, middle and outer cylindrically contoured regions, each of said regions having a different curvature, said lower flange having a second disc-supporting surface; a carrier shaft disposed between said flanges and adapted to engage a wall panel; and a trolley having upper and lower discs rotationally mounted on said shaft, said upper disc having a first lower surface supported on said first disc-supporting surface of said upper flange, and said lower disc having a second lower surface supported on said second disc-supporting surface of said lower flange.

14. The track and trolley system of claim 13, wherein the radius of curvature of each of said inner and outer regions is greater than the radius of curvature said middle region.

15. The track and trolley system of claim 14, wherein said inner, middle and outer regions have a radius of about 10 inches, 1 inch, and 4 inches, respectively.

16. The track and trolley system of claim 13, said second disc-supporting surface has second inner, second middle and second outer cylindrically contoured regions, each of said regions having a different curvature.

17. The track and trolley system of claim 16, wherein the radius of curvature of each of said second inner and second outer regions is greater than said radius of said second middle region.

18. The track and trolley system of claim 17, wherein said second inner, second middle and second outer regions have a radius of about 10 inches, 1 inch, and 4 inches, respectively.

19. The track and trolley system of claim 13, wherein said first lower surface of said upper disc includes an outer edge and a center, said first lower surface sloping from said outer edge toward said center such that said first lower surface is concave.

20. The track and trolley system of claim 19, wherein the slope of said first lower surface of said disc is about 4 degrees to the horizontal.

21. The track and trolley system of claim 19, wherein said channel has a center point defining a distance from said center point to said outer region of said upper flange, and said upper disc has a radius from said center to said outer edge corresponding to said distance.

22. The track and trolley system of claim 16, wherein said first lower surface of said upper disc defines a rounded contact point adjacent said outer edge, said rounded contact point abutting said outer region of said upper flange.

23. The track and trolley system of claim 16, said second lower surface of said lower disc includes an outer edge and a center, said second lower surface sloping from said outer edge toward said center such that said second lower surface is concave.

24. The track and trolley system of claim 23, wherein the slope of said second lower surface of said disc is about 4 degrees to the horizontal.

25. The track and trolley system of claim 23, wherein said channel has a center point defining a distance from said center point to said second outer region of said lower flange, and said lower disc has a radius from said center to said outer edge corresponding to said distance.

26. The track and trolley system of claim 23, wherein said second lower surface of said lower disc defines a rounded contact point adjacent said outer edge, said rounded contact point abutting said second outer region of said lower flange.

27. The track and trolley system of claim 13, wherein said upper and lower flanges are enclosed within a common housing.

28. The track and trolley system of claim 13, said shaft has a lower end extending below said lower flange and threaded for attachment to a movable wall panel.

29. A track and trolley system for movable wall panels comprising:

a track having upper and lower flanges, said upper and lower flanges being horizontally and vertically displaced from each other and defining a channel, said upper and lower flanges each having a disc-supporting surface including inner, middle and outer cylindrically contoured regions, said inner, middle and outer regions each having a different curvature;

a carrier shaft disposed between said flanges and adapted to engage the wall panel; and a trolley having upper and lower discs rotationally mounted on said shaft, said upper disc having a first lower surface supported on said disc-supporting surface of said upper flange, and said lower disc having a second lower surface supported on said disc-supporting surface of said lower flange.

30. The track and trolley system of claim 29, wherein the radius of curvature of each of said inner and outer regions is greater than said radius of said middle region.

31. The track and trolley system of claim 30, wherein said inner, middle and outer regions have a radius of about 10 inches, 1 inch, and 4 inches, respectively.

32. The track and trolley system of claim 29, wherein said first lower surface of said upper disc includes an outer edge and a center, said first lower surface sloping from said outer edge toward said center such that said first lower surface is concave.

33. The track and trolley system of claim 29, wherein the slope of said first lower surface of said disc is about 4 degrees to the horizontal.

34. The track and trolley system of claim 32, wherein said channel has a center point defining a distance from said center point to said outer region of said upper flange, and said upper disc has a radius from said center to said outer edge corresponding to said distance.

35. The track and trolley system of claim 34, wherein said first lower surface of said upper disc defines a rounded contact point adjacent said outer edge, said rounded contact point abutting said outer region of said upper flange.

36. The track and trolley system of claim 29, wherein said second lower surface of said lower disc includes an outer edge and a center, said second lower surface sloping from said outer edge toward said center such that said second lower surface is concave.

37. The track and trolley system of claim 36, wherein the slope of said second lower surface of said disc is about 4 degrees to the horizontal.

38. The track and trolley system of claim 36, wherein said channel has a center point defining a distance from said center point to said outer region of said lower flange, and said lower disc has a radius from said center to said outer edge corresponding to said distance.

39. The track and trolley system of claim 36, wherein said second lower surface of said lower disc defines a rounded contact point adjacent said outer edge, said rounded contact point abutting said outer region of said lower flange.

40. The track and trolley system of claim 39, wherein said shaft has a lower end extending below said lower flange and threaded for attachment to a movable wall panel.

41. A track and trolley system for movable wall panels comprising:

a track having upper and lower flanges, said upper and lower flanges being horizontally and vertically displaced from each other and defining a channel, said upper and lower flanges each including a disc-supporting surface having inner, middle and outer cylindrically contoured regions, each of said inner, middle and outer regions having a different curvature;

a carrier shaft disposed between said flanges and adapted to engage the wall panel; and a trolley having upper and lower discs rotationally mounted on said shaft, said upper and lower discs each having a lower surface supported on said disc-supporting surfaces of said upper and lower flanges, respectively, and each of said upper and lower discs including an outer edge and a center, each of said lower surfaces sloping from said outer edge toward said center such that each of said lower surfaces is concave.

42. The track and trolley system of claim 41, wherein the radius of curvature of each of said inner and outer regions is greater than the radius of said middle region.

43. The track and trolley system of claim 42, wherein said inner, middle and outer regions have a radius of about 10 inches, 1 inch, and 4 inches, respectively.

44. The track and trolley system of claim 41, wherein the slope of each of said lower surfaces of said upper and lower discs is about 4 degrees to the horizontal.

45. The track and trolley system of claim 41, said channel has a center point defining a distance from said center point to said outer region, and each of said upper and lower discs has a radius from said center to said outer edge corresponding to said distance.

46. The track and trolley system of claim 45, wherein each of said lower surfaces of said upper and lower discs defines a rounded contact point adjacent said outer edge, said rounded contact point of said upper and lower discs abutting said outer region of said upper and lower flanges, respectively.

* * * * *

UNITED STATES PATENT AND TRADEMARK OFFICE

CERTIFICATE OF CORRECTION

PATENT NO. : 6,581,242 B2
DATED : June 24, 2003
INVENTOR(S) : N. Douglas Owens

It is certified that error appears in the above-identified patent and that said Letters Patent is hereby corrected as shown below:

Column 4,
Line 27, after the word "claim" please insert -- 1 --

Column 6,
Line 6, delete "16" and insert -- 21 --
Line 60, delete "29" and insert -- 32 --

Column 7,
Line 18, delete "36" and insert -- 38 --

Signed and Sealed this

Eighteenth Day of November, 2003

JAMES E. ROGAN
*Director of the United States Patent and Trademark Office*